United States Patent [19]

Cassia

[11] 4,058,235

[45] Nov. 15, 1977

[54] DISPENSER FOR INTERLEAVED SHEETS OF TISSUE

[75] Inventor: Antonio Macchi Cassia, Milan, Italy

[73] Assignee: Steiner American Corporation, Salt Lake City, Utah

[21] Appl. No.: 707,370

[22] Filed: July 21, 1976

[30] Foreign Application Priority Data

May 28, 1976 Italy ..... 23763/76

[51] Int. Cl.[2] ..... B65D 85/16

[52] U.S. Cl. ..... 221/48; 221/61; 131/238

[58] Field of Search ..... 221/63, 45, 97, 98, 221/46, 48, 52, 62, 61; 131/238, 240 R

[56] References Cited

U.S. PATENT DOCUMENTS

| | | | |
|---|---|---|---|
| 2,306,579 | 12/1942 | West | 221/62 X |
| 3,019,940 | 2/1962 | Sutton | 221/48 |

*Primary Examiner*—Stanley H. Tollberg
*Attorney, Agent, or Firm*—Vogel, Dithmar, Stotland, Stratman & Levy

[57] ABSTRACT

A tissue dispenser includes an integral, open-top, generally rectangular container formed of transparent plastic material and including a bottom wall having inclined central portions which converge upwardly into the container and have the upper ends thereof spaced apart to define a dispensing opening, the container adapted to receive therein through the open top a stack of folded interleaved tissue sheets, the bottom sheet resting upon the upper ends of the inclined bottom wall portions, with the leading end thereof extending outwardly through the dispensing opening for access by a user. A removable metal cover may be latched in place to close the open end of the container, the cover having an ashtray and cigarette holding grooves formed therein. Three pockets are integrally formed on the outer surface of the rear wall of the container, one lower pocket opening downwardly to be slipped over a mounting washer secured to a support wall, the other upper pockets opening upwardly and receiving mounting washers therein, mounting screws being received through complementary aligned openings in the container wall, upper pockets and washers for threaded engagement with the support wall.

13 Claims, 9 Drawing Figures

DISPENSER FOR INTERLEAVED SHEETS OF TISSUE

BACKGROUND OF THE INVENTION

The present invention relates to tissue dispensers and, more particularly, to a dispenser for dispensing individual sheets of tissue, such as bathroom tissues, one at a time from a stack of folded interleaved sheets of tissue.

Previous dispensers for this type of tissue have typically comprised a wall-mounted container having a tissue-dispensing opening at the bottom. These prior dispensers have typically been formed of metal and have suffered from a number of disadvantages. The opaque metal containers were relatively expensive to manufacture and to maintain. Furthermore, the opaque metal rendered it difficult to determine when the stack of tissues in the container was about to be depleted and, consequently, the tissue supply often ran out.

In addition, with such prior dispensers, the dispensing of the tissue sheets was non-uniform, often resulting in more than one sheet at a time being inadvertently pulled from the container by the user, with attendant waste of tissues.

SUMMARY OF THE INVENTION

In order to improve on these deficiencies of prior art dispensers, it is an important feature of the present invention that there is provided an integral one-piece molded plastic housing of simple and economical construction, which forms a container for a stack of folded interleaved tissues.

It is another feature of this invention that the tissues in the container may readily be viewed by a user or service personnel.

Yet another feature of this invention is that the container is arranged for cooperation with the stack of sheets to facilitate dispensing of sheets only one at a time.

Another feature of this invention is the provision of an improved latchable cover for the container.

Another feature of the invention is the provision of an improved mounting arrangement for the container.

These features are accomplished in the present invention and it is an object of the present invention to accomplish these desired results by providing a tissue dispenser for dispensing individual sheets of tissue from a stack of folded and interleaved sheets, the dispenser comprising an integral one-piece housing including four interconnected upstanding side walls and a bottom wall closing the side walls and cooperating therewith to define a tissue container for accommodating a stack of folded and interleaved tissue sheets therein, a removable cover for closing the upper end of the container, the bottom wall including two substantially coplanar portions respectively extending inwardly from two opposed ones of the side walls substantially normal thereto and two inclined portions respectively integral with the flat portions at the inner edges thereof and converging upwardly into the container, the upper edges of the inclined portions being spaced apart and cooperating to define a dispensing slot having a width substantially less than the width of the sheets, the container being adapted to receive the associated stack of tissues therein with the bottommost tissue resting upon the upper ends of the inclined portions and having the free end thereof extending through the dispensing opening and below the container for access by a user, the exertion of a withdrawing force on the free end of the bottommost tissue by a user serving to remove the tissue from the container and pull the leading end of the next interleaved tissue through the dispensing opening for access by the user, whereby the sheets may be dispensed one at a time from the container.

It is another object of this invention to provide a container of the type set forth, which includes mounting pockets on the rear wall thereof adapted for cooperation with mounting washers, one of the pockets being adapted to be slipped over a mounting washer attached to a support wall and the other pocket being adapted to receive mounting washers therein and to receive a suitable fastener through complementary openings in the washers and in the container.

Further features of the invention pertain to the particular arrangement of the parts of the tissue dispenser whereby the above-outlined and additional operating features thereof are attained.

The invention, both as to its organization and method of operation, together with further objects and advantages thereof, will best be understood by reference to the following specification taken in connection with the accompanying drawings.

DESCRIPTION OF THE PREFERRED EMBODIMENT

Figure 1:
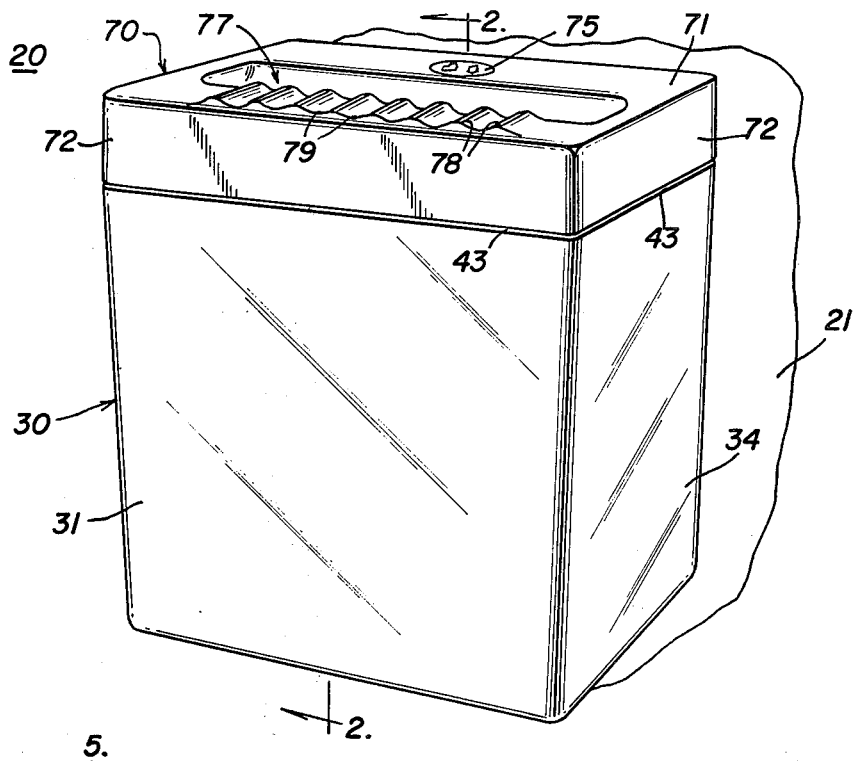
FIG. 1 is a front perspective view of a tissue dispenser constructed in accordance with and embodying the features of the present invention.

Referring now to FIGS. 1 through 4 of the drawings, there is disclosed a tissue dispenser, generally designated by the numeral 20, which is adapted to be mounted upon an associated vertical support wall 21 for containing a stack 25 of individual folded, interleaved sheets 26 of tissue, such as bathroom tissue, and dispensing the sheets 26 one at a time. The dispenser 20 includes an integral one-piece housing, generally designated by the numeral 30, which is preferably molded of a transparent material such as a suitable plastic. The housing 30 is generally box-like in configuration and includes a front wall 31, a rear wall 32, and a pair of opposed side walls 33 and 34, all interconnected at the lower ends thereof by a bottom wall, generally designated by the numeral 35.

The bottom wall 35 includes generally coplanar flat portions 36 and 37 respectively integral with the front and rear walls 31 and 32 and projecting inwardly therefrom substantially normal thereto and extending from the side wall 33 to the side wall 34, the flat portions 36 and 37 being respectively integral at the inner ends thereof with upwardly and inwardly inclined portions 38 and 39 which form a bottom recess 40. The inclined portions 38 and 39 are inclined at an angle of approximately 30° to the flat portions 36 and 37 and respectively terminate at upper ends 41 and 42 which are spaced apart a predetermined distance and cooperate to define a dispensing opening 45 in the bottom wall 35. Preferably, the dispensing opening 45 extends the entire length of the container 30 between the side walls 33 and 34 and has a front-to-back width approximately one-fifth of the front-to-back width of one of the sheets 26 of tissue to be dispensed.

Figure 4:
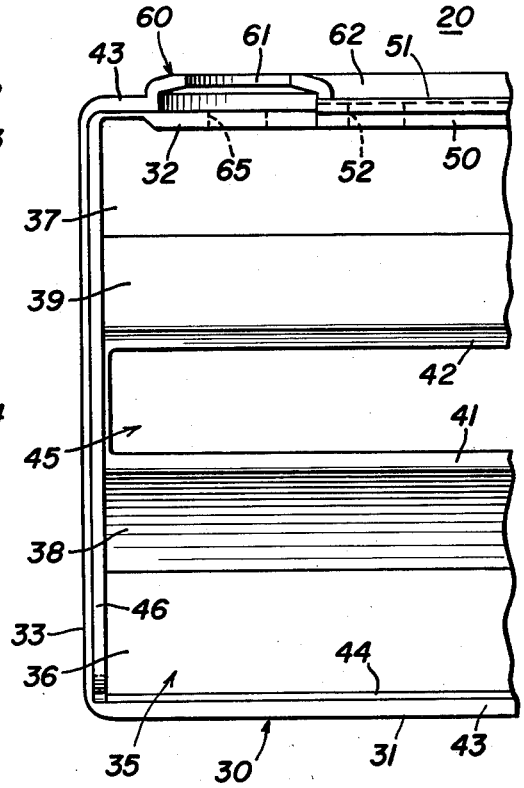
FIG. 4 is a fragmentary top plan view of the dispenser of FIG. 2, with the cover removed.
Figure 5:
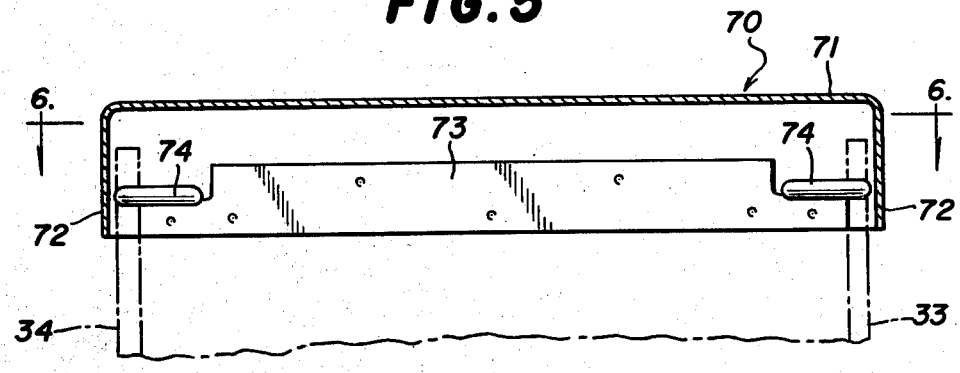
FIG. 5 is a fragmentary view in vertical section taken along the line 5—5 in FIG. 2.
Figure 6:
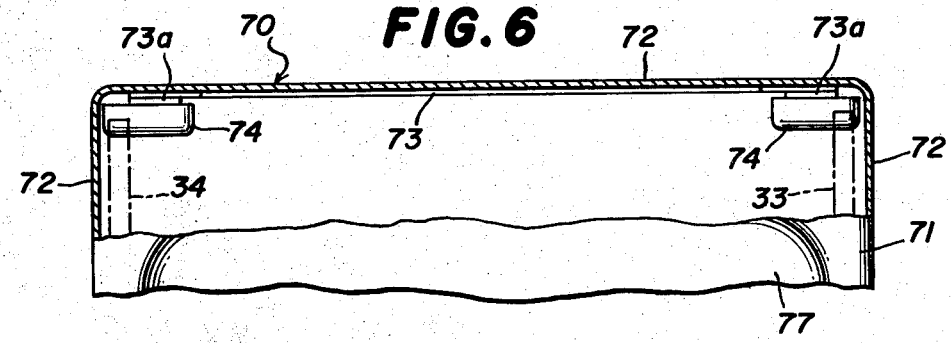
FIG. 6 is a fragmentary top plan view in partial horizontal section taken along the line 6—6 in FIG. 5.
Figure 7:
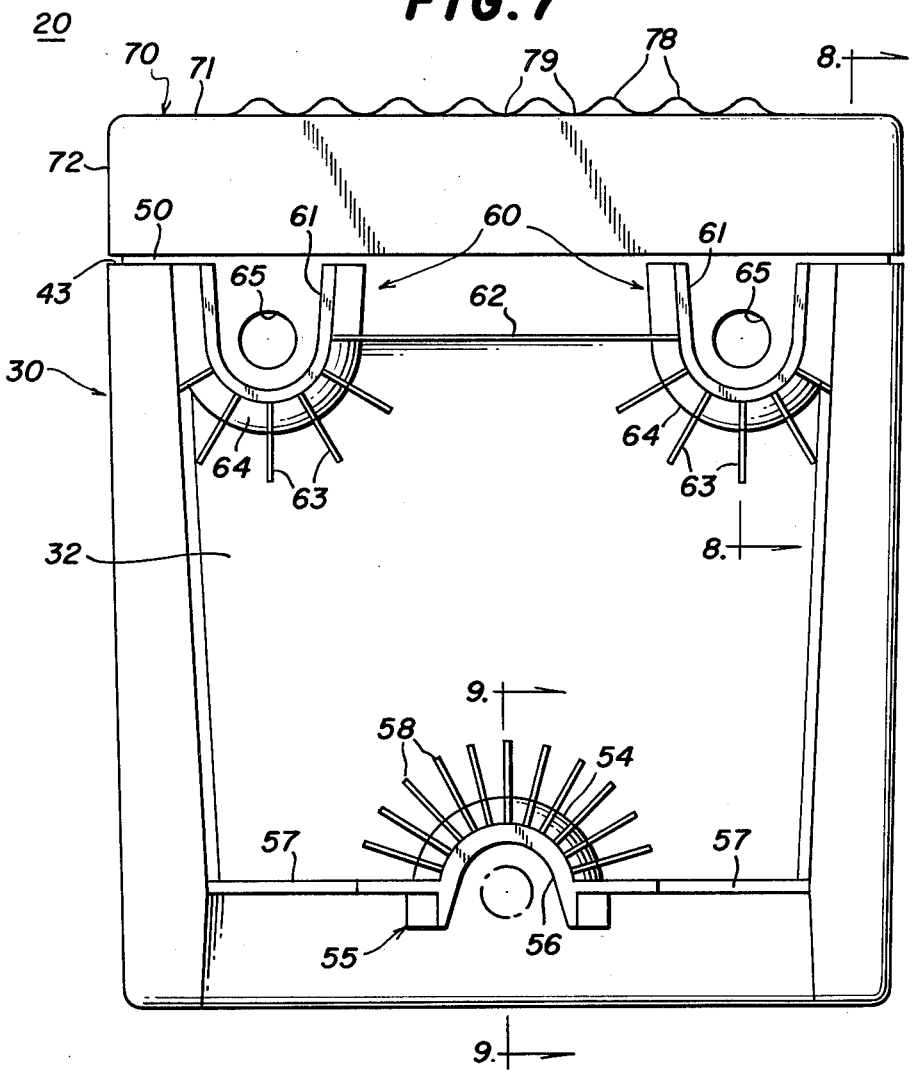
FIG. 7 is a rear elevational view of the dispenser of FIG. 2.
Figure 8:
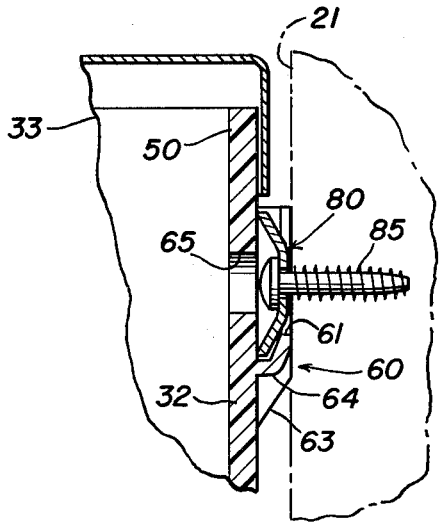
FIG. 8 is a fragmentary view in vertical section taken along the line 8—8 in FIG. 7.

The walls 31 through 34 are recessed adjacent to the upper ends thereof to define a substantially horizontal shoulder 43 which extends the entire width of the front wall 31 and side walls 33 and 34 and extends inwardly from the opposite edges of the rear wall 32 a short distance (see FIG. 4). The front wall 31 is provided with a short, thin, upstanding lip 44 which extends a short distance upwardly above the shoulder 43. The side walls 33 and 34 are respectively provided at the upper ends thereof with upstanding relatively thin flanges 46 and 47 which extend well above the upper edge of the front lip 44, and are each provided at the front edge thereof with a rearwardly extending arcuate notch or recess 48 (see FIG. 2). In like manner, the rear wall 32 is provided at the upper end thereof with an upstanding flange 50 which extends upwardly to the same height as the side flanges 46 and 47 and is provided with a somewhat thickened central portion 51 which extends a slight distance upwardly above the level of the side flanges 46 and 47. Formed through the rear flange 50 and central portion 51 thereof adjacent to the end of the latter closest to the side wall 33 is a rectangular keeper aperture 52, for a purpose to be described more fully hereinafter.

The inner surface of the rear wall 32 has vertically extending recesses 53 formed therein along the opposite side edges thereof, which recesses 53 respectively intersect the inner surfaces of the side walls 33 and 34. The front wall 31 is inclined slightly with respect to the rear wall 32, preferably at an angle of approximately 2°, whereby the front and rear walls 31 and 32 converge downwardly toward the bottom wall 35. In like manner, the side walls 33 and 34 are inclined with respect to each other and converge downwardly toward the bottom wall 35, each of the side walls 33 and 34 preferably being inclined at an angle of approximately 91° with respect to the flat portions 36 and 37 of the bottom wall 35. Thus, it will be appreciated that the container 30 is slightly funnel-shaped, having a cross sectional area adjacent to the bottom thereof only slightly greater than the area of a folded tissue sheet 26, to facilitate insertion of a stack 25 of tissue sheets 26 into the container 30, as will be described more fully below.

Integral with the rear wall 32 and projecting rearwardly therefrom adjacent to the lower end thereof and substantially midway between the side walls 33 and 34 is a lower pocket, generally designated by the numeral 55, which has a closed arcuate upper end 54 and is open at the lower end thereof. The pocket 55 is provided with a slot 56 in the outer wall thereof which extends upwardly from the open lower end thereof centrally thereof and gives the pocket 55 a generally inverted U-shaped appearance. Extending rearwardly from the rear surface of the rear wall 32 and respectively extending laterally from the opposite sides of the pocket 55 toward the adjacent side walls 33 and 34 are support ribs 57. Extending radially outwardly from the closed end of the pocket 55 along the rear surface of the rear wall 32 are a plurality of spaced-apart stiffening rays or ribs 58.

Also integral with the rear wall 32 and projecting rearwardly therefrom adjacent to the upper end thereof and respectively disposed adjacent to the side walls 33 and 34 and substantially equidistantly spaced from the lower pocket 55 are a pair of upper pockets, each generally designated by the numeral 60, and each having a closed arcuate lower end 64 and being opened at the upper end thereof, which upper end is substantially coplanar with the shoulder 43. Each of the pockets 60 is provided with a slot 61 in the outer wall thereof centrally thereof which extends downwardly from the open end thereof and gives the pocket 60 a generally U-shaped appearance. Extending rearwardly from the rear wall 32 integral therewith and interconnecting the inner sides of the upper pockets 60 is a support rib 62. Extending generally radially outwardly from the closed end of each of the upper pockets 60 along the rear surface of the rear wall 32 is a plurality of spaced-apart stiffening rays or ribs 63. Respectively extending through the rear wall 32 in line with the slots 61 and respectively substantially concentric with the arcuate closed ends 64 of the pockets 60 are two circular apertures 65.

The dispenser 20 is also provided with a cover, generally designated by the numeral 70, which is preferably formed of metal, and includes a generally rectangular top wall 71 and a peripheral wall 72 which is integral with the top wall 71 and extends downwardly therefrom around the entire circumference thereof, the peripheral wall 72 having a vertical height slightly less than the vertical distance between the shoulder 43 and the upper edge of the central portion 51 of the rear flange 50. Thus, the cover 70 is receivable over the front lip 44 and side wall and rear wall flanges 46, 47 and 50, with the lower edge of the peripheral wall 72 overlying the shoulder 43, and with the upper edge of the central portion 51 of the rear flange 50 abutting the underside of the top wall 71 of the cover 70. Fixedly secured to the inner surface of the front portion of the peripheral wall 72, as by spot welding, is a generally rectangular mounting plate 73 provided adjacent to the opposite ends thereof with two inwardly extending pivot tabs 73*a*, which are respectively disposed for reception in the notches 48 of the side flanges 46 and 47 when the cover 70 is mounted in place in the position illustrated in FIG. 2. Preferably, each of the pivot tabs 73*a* is covered with a resilient cap 74 which may be formed of rubber or the like.

Mounted beneath the top wall 71 adjacent to the rear edge thereof is a key-operated lock assembly 75 of standard construction, which includes a latch member 76 disposable for engagement in the keeper aperture 52 in the rear wall flange 50 for preventing removal of the cover 70 from the container 30. The top wall 71 of the cover 70 is also provided with a recess or depression 77 formed centrally therein, which serves to define an ashtray for cigarettes and the like, the top wall 71 also being provided with a plurality of spaced-apart ridges 78 extending between the front edge of the top wall 71 and the ashtray recess 77 and cooperating to define a plurality of cigarette holder grooves or channels 79.

For mounting the dispenser 20 on the support wall 21, there are also provided three identical washers, each generally designated by the numeral 80, and each including a generally frustoconical side wall 81 closed at the small end thereof by a flat circular end wall 82 having a circular opening 83 formed centrally therethrough, whereby the washer 80 forms a shallow generally concave or dish-like member having a concave or inner surface 84. The diameter of the washer 80 is such that it can be received in each of the pockets 55 and 60 by sliding it in from the open end thereof, but the diameter of the washer 80 is greater than the widths of the slots 56 and 61 so that the washers 80 cannot be passed through those slots. Furthermore, the depth of the washer 80 from the outer surface of the end wall 82 to the tip of the wide end of the frustoconical wall 81 is greater than the thickness of the pockets 55 and 60 between the outer walls thereof and the rear wall 32 of the container 30, the central portions of the washers 80 being accommodated in the slots 56 and 61 to permit insertion of the washers 80 into the pockets 55 and 60. When the washer 80 is inserted in either one of the upper pockets 60 in engagement with the closed lower end thereof, the opening 83 in the washer 80 is disposed substantially concentrically with the corresponding aperture 65 through the container rear wall 32.

Figure 2:
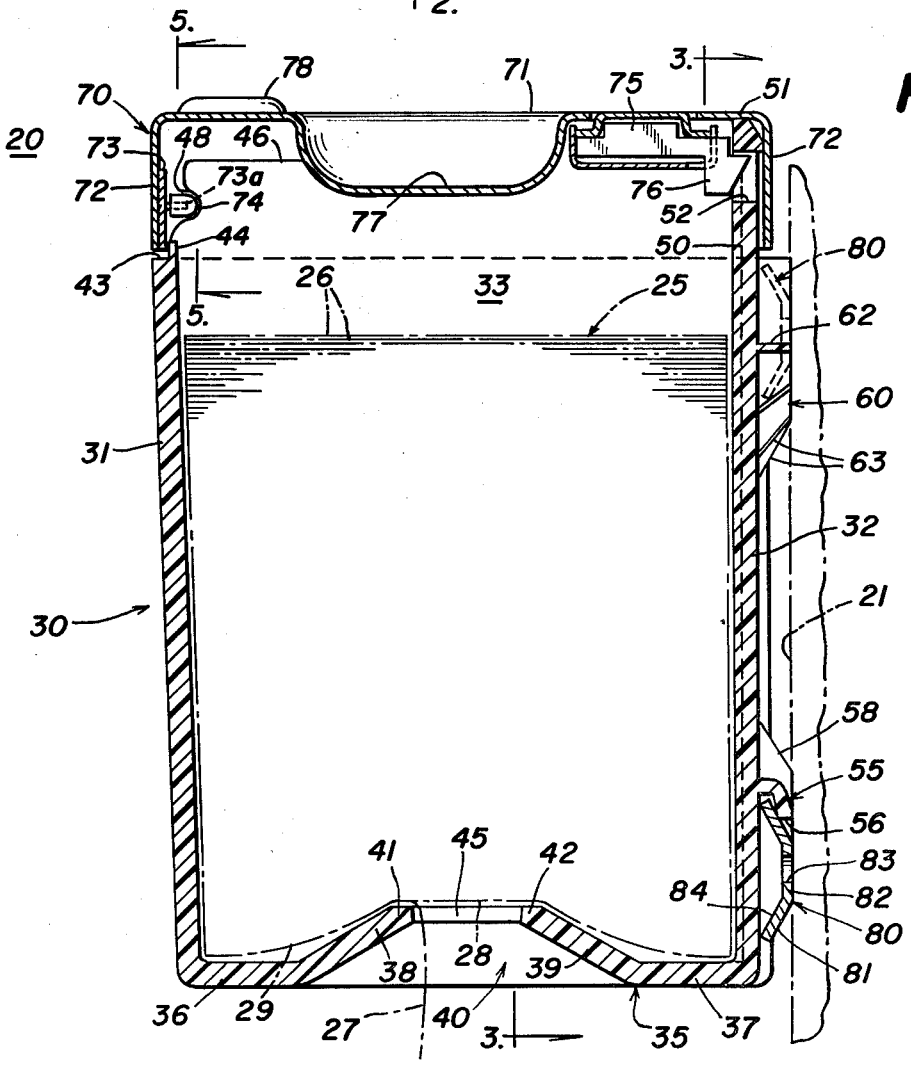
FIG. 2 is an enlarged view in vertical section taken along the line 2—2 in FIG. 1.
Figure 3:
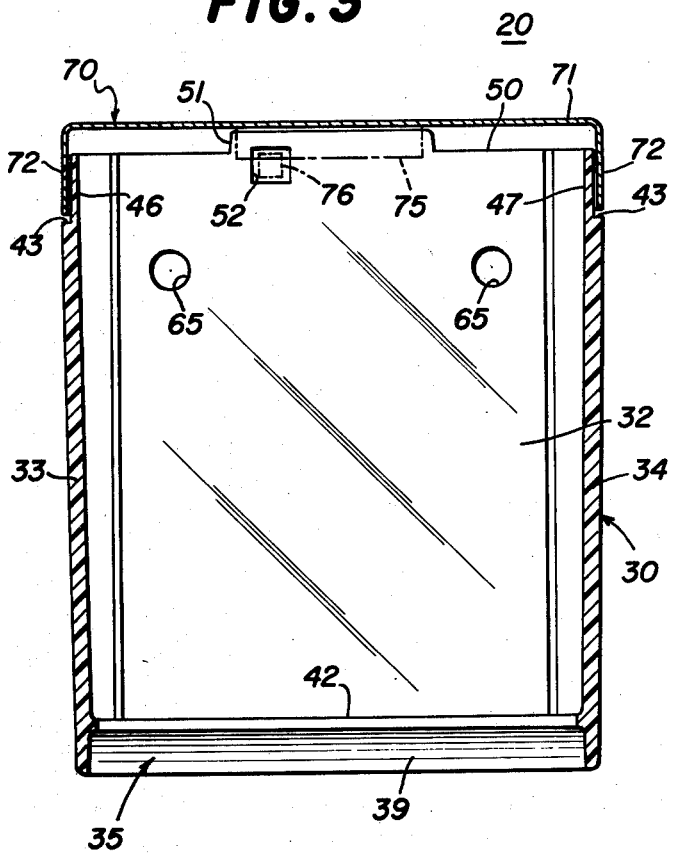
FIG. 3 is a reduced view in vertical section taken along the line 3—3 in FIG. 2.
Figure 9:
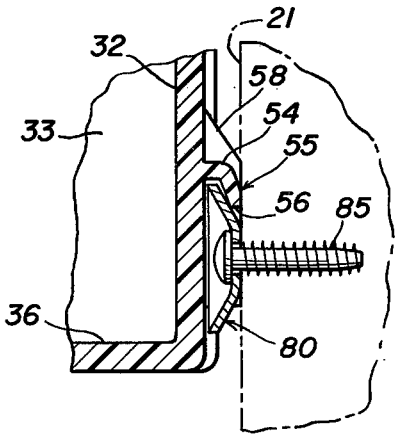
FIG. 9 is a fragmentary view in vertical section taken along the line 9—9 in FIG. 7.

In use, one of the washers 80 is fixedly secured to the support wall 21 by passing a suitable fastener such as a screw or bolt 85 through the opening 83 and into the support wall 21, with the concave surface 84 of the washer 80 facing outwardly, as illustrated in FIGS. 2 and 9. The lower pocket 55 of the container 30 may then be slid down over the washer 80 and be supported thereon. The other two washers 80 are respectively disposed in the upper pockets 60. When the lower pocket 55 is slipped down over the lower washer 80, the upper pockets 60 containing the other two washers 80 are pushed back flush against the outer surface of the support wall 21 and screws 65 are passed through the aperture 65 in the container end wall 32 and the apertures 83 in the washers 80 for threaded engagement with the support wall 21 and cooperation with the lower washer 80 securely to fasten the container 30 to the support wall 21. It will be noted that the apertures 65 are disposed close enough to the upper end of the container 30 that they are accessible by a screwdriver when the cover 70 is removed.

When thus mounted in place, a stack 25 of tissue sheets 26 is dropped into the container 30 from the open top thereof, the converging side walls 33 and 34 and converging front and rear walls 31 and 32 serving to accurately position the stack 25 on the bottom wall 35 of the container 30. The free end 27 of the bottommost sheet is pulled through the dispensing opening 45 so as to extend downwardly therebelow and be accessible by a user. The central portion 28 of the bottommost tissue 26 rests upon the upper ends 41 and 42 of the bottom wall inclined portions 38 and 39, with the front and rear sides 29 of the lowermost tissues 26 in the stack 25 dropping down generally along the inner surfaces of the inclined portions 38 and 39 and flat portions 36 and 37 of the bottom wall 35. This arrangement serves to provide increased frictional resistance between the lowermost tissue 26 and the upper ends 41 and 42 of the bottom wall inclined portions 38 and 39 adjacent to the dispensing opening 45, to insure that the force necessary to withdraw the bottommost tissue 26 through the dispensing opening 45 is greater than the force necessary to separate that bottommost tissue from the next interleaved tissue in the stack. Thus, this arrangement serves to facilitate the one-at-a-time dispensing of tissue sheets 26 from the container 30, and to minimize the possibility of more than one sheet being dispensed at the same time.

Because the container 30 is transparent, the number of tissues left in the container 30 is always readily apparent to the user and to service personnel, so that when the stack 25 gets low, a new supply of tissues may be added to the container 30 before the container is empty. When thus adding a new supply of tissues to the container 30, the cover 70 is unlocked and removed from the container 30, at which time the ashtray 77 may be emptied. When the container 30 has been refilled, the cover 70 is replaced thereon by first inserting the pivot tabs **73*a* in the notches 48 and then pivoting the rear end of the cover 70 downwardly over the rear flange 50 until the latch 76 engages in the keeper aperture 52**.

It will be appreciated that, while the container 30 is preferably formed of a modable material such as plastic or the like, it may also be formed of any other suitably rugged transparent material. Also, the transparent material of the container 30 is preferably tinted to enhance the general appearance thereof and increase the visibility thereof.

From the foregoing, it can be seen that there has been provided an improved tissue dispenser which is of simple and economical construction and provides for ready visibility of the supply of tissues contained therein, the dispenser also being characterized by ease of installation and maintenance.

There has also been provided an improved tissue dispenser of the character described, which has a unique mounting arrangement for securely and yet simply and easily fastening the dispenser to an associated support surface.

There has also been provided a tissue dispenser of the character described which affords improved dispensing operation to minimize the possibility of more than one tissue sheet at a time being dispensed.

While there has been described what is at present considered to be the preferred embodiment of the invention, it will be understood that various modifications may be made therein, and it is intended to cover in the appended claims all such modifications as fall within the true spirit and scope of the invention.

What is claimed is:

1. A tissue dispenser for dispensing individual sheets of tissue from a stack of folded and interleaved sheets, said dispenser comprising an integral one-piece housing including four interconnected upstanding side walls and a bottom wall closing said side walls and co-operating therewith to define a tissue container for accommodating a stack of folded and interleaved tissue sheets therein, and a removable cover for closing the upper end of said container, said cover being formed of metal and having a recess formed in the top thereof to define an ashtray, said cover further having a plurality of ridges projecting upwardly therefrom along the front edge of said ashtray recess and co-operating to define a plurality of channels for holding cigarettes, said bottom wall including two substantially coplanar portions respectively extending inwardly from two opposed ones of said side walls substantially normal thereto and two inclined portions respectively integral with said flat portions at the inner edges thereof and converging upwardly into said container, the upper edges of said inclined portions being spaced apart and co-operating to define a dispensing slot having a width substantially less than the width of the sheets, said container being adapted to receive the associated stack of tissues therein with the bottommost tissue resting upon the upper ends of said inclined portions and having the free end thereof extending through said dispensing opening and below said container for access by a user, the exertion of a withdrawing force on the free end of the bottommost tissue by a user serving to remove said tissue from said container and pull the leading end of the next interleaved tissue through the dispensing opening for access by the user, whereby said sheets may be dispensed one at a time from said container.

2. The tissue dispenser set forth in claim 1, wherein said housing is formed of transparent plastic material.

3. The tissue dispenser set forth in claim 1, wherein said housing is formed of a tinted transparent plastic material.

4. The tissue dispenser set forth in claim 1, and further including latch means on said cover for cooperation with said container to latch said cover thereto for closing the upper end thereof.

5. The tissue dispenser set forth in claim 1, wherein at least portions of two opposed ones of said side walls converge downwardly.

6. The tissue dispenser set forth in claim 1, wherein said dispensing opening is disposed centrally of said bottom wall.

7. The tissue dispenser set forth in claim 1, wherein said dispensing opening has a width approximately one-fifth of the width of the associated tissue sheets.

8. A tissue dispenser for dispensing individual sheets of tissue from a stack of folded and interleaved sheets, said dispenser comprising an integral one-piece housing defining a tissue container for accommodating a stack of folded and interleaved tissue sheets therein, said housing having a refill opening adjacent to the upper end thereof for placing the stack of sheets into the container and a dispensing opening adjacent to the lower end thereof for dispensing tissue sheets therefrom, a removable cover for closing the upper end of said container, a first downwardly-opening pocket formed integrally with the outer surface of said container adjacent to the lower end thereof and having a slot therein extending upwardly from the open end thereof, a second upwardly-opening pocket formed integrally with the outer surface of said container adjacent to the upper end thereof and having a slot therein extending downwardly from the open end thereof, and first and second generally concave mounting members respectively having depths greater than the thicknesses of said first and second pockets and widths greater than the widths of said slots and adapted to be received in said pockets from the open ends thereof with the convex sides facing outwardly of said container and being respectively accommodated by said slots, said first mounting member being adapted to be fixedly secured to an associated support surface so that said first pocket may be slipped downwardly thereover, said container having an opening therethrough in alignment with said slot of said second pocket, said second mounting member having an opening therethrough disposed for alignment with said opening in said container when said second mounting member is received in said second pocket for receiving an associated fastening means therethrough for cooperation with said first mounting member and said first pocket securely to fasten said container to the associated support surface.

9. The tissue dispenser set forth in claim 8, wherein each of said pockets is generally U-shaped, having a rounded closed end.

10. The tissue dispenser set forth in claim 8, and further including a plurality of stiffening ribs extending generally radially outwardly from the closed end of each of said pockets.

11. The tissue dispenser set forth in claim 8, wherein each of said mounting members comprises a generally frustoconical washer having a flat circular wall closing the small end thereof.

12. The tissue dispenser set forth in claim 8, wherein said container includes two of said second pockets spaced apart substantially in horizontal alignment with each other and equidistantly spaced from said first pocket.

13. A tissue dispenser for dispensing individual sheets of tissue from a stack of folded and interleaved sheets, said dispenser comprising an integral one-piece housing including four interconnected upstanding side walls and a bottom wall closing said side walls and cooperating therewith to define a tissue container for accommodating a stack of folded and interleaved tissue sheets therein, a removable cover for closing the upper end of said container, a first downwardly-opening pocket formed integrally with the outer surface of one of said side walls adjacent to the lower end thereof and having a slot therein extending upwardly from the open end thereof, a second upwardly-opening pocket formed integrally with the outer surface of said one side wall adjacent to the upper end thereof and having a slot therein extending downwardly from the open end thereof, and first and second generally concave mounting members respectively having depths greater than the thicknesses of said first and second pockets and widths greater than the widths of said slots and adapted to be received in said pockets from the open ends thereof with the convex sides facing outwardly of said container and being respectively accommodated by said slots, said first mounting member being adapted to be fixedly secured to an associated support surface so that said first pocket may be slipped downwardly thereover, said container having an opening therethrough in alignment with said slot of said second pocket, said second mounting member having an opening therethrough disposed for alignment with said opening in said container when said second mounting member is received in said second pocket for receiving an associated fastening means therethrough for cooperation with said first mounting member and said first pocket securely to fasten said container to the associated support surface, said bottom wall including two substantially coplanar portions respectively extending inwardly from two opposed ones of said side walls substantially normal thereto and two inclined portions respectively integral with said flat portions at the inner edges thereof and converging upwardly into said container, the upper edges of said inclined portions being spaced apart and cooperating to define a dispensing slot having a width substantially less than the width of the sheets, said container being adapted to receive the associated stack of tissues therein with the bottommost tissue resting upon the upper ends of said inclined portions and having the free end thereof extending through said dispensing opening and below said container for access by a user, the exertion of a withdrawing force on the free end of the bottommost tissue by a user serving to remove said tissue from said container and pull the leading end of the next interleaved tissue through the dispensing opening for access by the user, whereby said sheets may be dispensed one at a time from said container.

* * * * *